United States Patent [19]

Nikkel

[11] 4,369,555

[45] Jan. 25, 1983

[54] YARN PROCESSING APPARATUS

[75] Inventor: Ronnie D. Nikkel, Bartlesville, Okla.

[73] Assignee: Phillips Petroleum Company, Bartlesville, Okla.

[21] Appl. No.: 157,584

[22] Filed: Jun. 9, 1980

Related U.S. Application Data

[60] Division of Ser. No. 955,047, Oct. 26, 1978, Pat. No. 4,235,000, which is a division of Ser. No. 822,177, Aug. 5, 1977, Pat. No. 4,135,511, which is a continuation of Ser. No. 692,713, Jun. 4, 1976, abandoned.

[51] Int. Cl.³ ..... D02G 1/12; D02G 1/16; D02G 1/20

[52] U.S. Cl. ..... 28/221; 28/248; 28/255; 28/258; 28/290

[58] Field of Search ..... 28/221, 240, 241, 248, 28/249, 250, 255, 258, 290; 34/49, 54

[56] References Cited

U.S. PATENT DOCUMENTS

| | | | |
|---|---|---|---|
| 2,641,062 | 6/1963 | Wentz | 34/54 X |
| 2,977,663 | 4/1961 | Evans | 34/49 X |
| 3,961,401 | 6/1976 | Ferrier et al. | 28/249 |
| 3,977,058 | 8/1976 | Borenstein et al. | 28/249 |

*Primary Examiner*—Robert Mackey

[57] ABSTRACT

The temperature of a heating fluid used in a yarn crimping zone is controlled in response to whether a yarn plug is detected at a predetermined point, and in another embodiment a fluid is heated, passed to a yarn heating zone and a yarn is heated in the zone in response to whether the yarn is being wound in a yarn winding zone.

13 Claims, 1 Drawing Figure

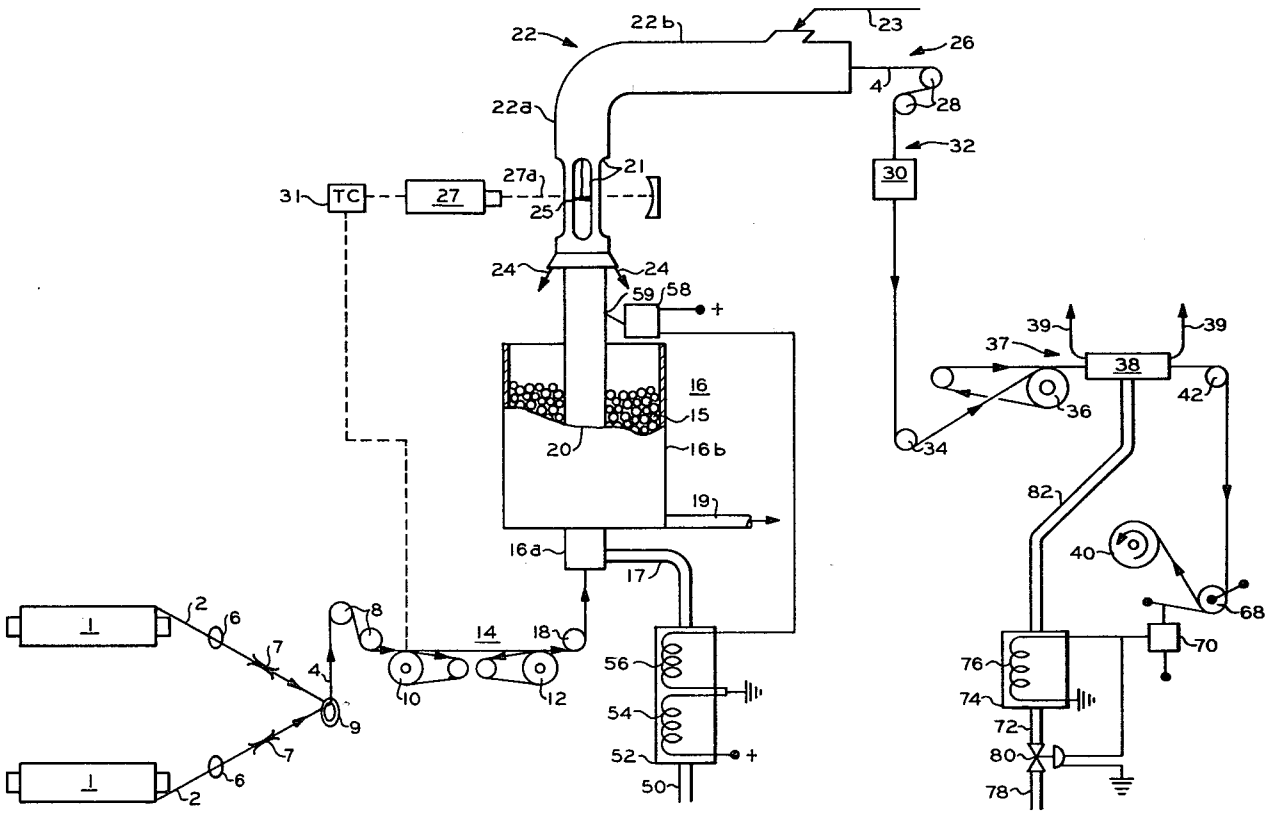
TC
T
T

YARN PROCESSING APPARATUS

This application is a division of my copending application Ser. No. 955,047 filed Oct. 26, 1978, now U.S. Pat. No. 4,235,000, granted Nov. 25, 1980, which is a division of application Ser. No. 822,177, filed Aug. 5, 1977, now U.S. Pat. No. 4,135,511 granted Jan. 23, 1979, which is a continuation of application Ser. No. 692,713, filed June 4, 1976, now abandoned.

BACKGROUND OF THE INVENTION

The invention relates to methods and apparatus for processing yarn. In another aspect the invention relates to a method and apparatus useful for regulating the temperature of a heating fluid used in a yarn crimping zone. In another aspect the invention relates to a method and apparatus useful for regulating a heating fluid used in a yarn heating zone.

It is frequently desirable to crimp a yarn and thereby produce a yarn having increased bulk and cover and improved hand.

In a number of yarn crimping operations, the yarn is subjected to heating prior to and/or during the actual crimping operation. It is not uncommon to use a heating fluid to heat the yarn and the processing equipment either directly or indirectly to a temperature at or above the melting point of the yarn. In order to minimize the time required to start up the operation, the yarn and equipment are often heated directly or indirectly by the heating fluid during the stringing up operation which can cause the yarn to melt, complicating the start up operation.

It is also desirable to heat a textured yarn prior to winding in order to produce a straightened textured yarn for easier handling and where the texture of the yarn will return subsequently applying heat to the yarn. Frequently the textured yarn is heated in a straightening zone immediately preceding the winder and during the doffing operation or stringing up of the processing line there is a tendency for the yarn to wrap the pull off rolls.

An object of the invention is to prevent yarn from melting in a yarn texturing zone during string up of the processing line. Another object of the invention is to prevent yarn from wrapping pull off rolls during string up of the processing line or doffing of the winder.

Other objects, aspects and advantages of the invention will be apparent to those skilled in the art after studying the specification, drawing and appended claims.

SUMMARY OF THE INVENTION

According to the invention a yarn is passed to a crimping zone, a fluid is passed to a fluid heating zone capable of heating the fluid to a first or a second temperature, the yarn is monitored to detect the presence or absence of the yarn at a predetermined point, the fluid is heated to the first temperature if the yarn is not detected at said point or to the second temperature if the yarn is detected at said point, and the heated fluid is passed to the yarn crimping zone.

Further according to the invention, yarn is passed to a heating zone suitable to straighten the yarn by subjecting the yarn to heat and tension; subsequently passing the yarn to a winding zone; the yarn is monitored to determine if the yarn is being wound; and a fluid is passed to a fluid heating zone, heated to a suitable temperature in said zone, passed to the yarn heating zone, and the yarn is heated therein by said heated fluid only if yarn is being wound in the winding zone.

Further according to the invention, the apparatus comprises yarn crimping means for heating a yarn with a heated fluid and producing a yarn plug; fluid heating means for heating a fluid to a first or a second temperature, the second temperature being a higher temperature than the first temperature; means connecting the fluid heating means to the yarn crimping means for passage of the heated fluid from the fluid heating means to the yarn crimping means; control means for regulating the temperature of the heated fluid heated by the heating means to the first temperature or the second temperature in response to whether the yarn plug is detected at a predetermined point so that the heated fluid is heated to the first temperature if yarn plug is not detected at said point and the heated fluid is heated to the second temperature if the yarn plug is detected at said point.

Further according to the invention, the apparatus comprises yarn heating means for heating a yarn with a heated fluid; fluid heating means for heating a fluid to a temperature; means connecting the fluid heating means to the yarn heating means for passage of the heated fluid from the fluid heating means to the yarn heating means; winding means positioned to wind the heated yarn; and heating fluid control means for controlling the passage of heated fluid from the fluid heating means to the yarn heating means in response to the winding of yarn so that heating fluid is passed to the yarn heating means only if yarn is being wound.

DETAILED DESCRIPTION OF THE INVENTION

The drawing is a schematic flow sheet representing an embodiment of the present invention.

This invention involves a method and apparatus for controlling heating fluids used in processing yarn. In one embodiment of the invention, when yarn is crimped in a suitable crimping means as a fluid jet, designated generally as reference numeral 16 in the drawing, the invention relates to a method and apparatus for controlling the heating fluid used in the crimping means. In another embodiment of the invention, when a crimped or textured yarn is processed by heating the yarn under tension, such as in straightening zone 37 shown in the drawing, the invention relates to a method and apparatus for controlling the heating fluid used in the straightening zone. Before describing the invention in more detail, the drawing will be described.

In the drawing a continuous filament synthetic yarn 2 is fed from a plurality of packages 1 through eyelet guides 6 and tensioned by tensioning gates 7 to control the yarn coming from the packages. The yarn is brought together in guide 9 to form yarn 4 of the desired total denier and tensioned by tensioning pins 8 to provide better control of the yarn. The yarn 4 is fed to a heated feed roll 10 and then to a heated draw roll 12 to draw yarn 4 in zone 14. The yarn is then fed to suitable crimping means 16. Crimping means 16 includes a fluid jet **16*a* and a chamber 16*b* containing a plurality of stacked members such as balls 15. A heated fluid, such as superheated steam, enters the jet 16*a* through inlet 17 to heat the yarn and produce yarn plug 20. Steam exits through stacked members 15 and steam and/or condensate exit through outlet 19. An adjustable angle idler 18 is used to insert a controllable amount of false twist into the yarn prior to crimping. This is useful in controlling the heat losses from the yarn and, hence, the yarn temperature entering the crimping means 16. The yarn plug 20 formed in crimping means 16 is passed through a tube 22 in which the yarn plug 20 is broken up and cooled by countercurrent air 23 or other suitable fluid passing through portions 22***a* and 22*b* of tube 22 against the end 25 of plug 20, and exhausting through slots 21 and the perimeter 24 of the upstream end of tube 22.

In this embodiment of the invention as shown in the drawing, the heating fluid such as steam used in the jet 16*a* of crimping means 16 is superheated via heating means 52 which can be any suitable heating means and in the drawing is shown as an electrical heater having two electrical heating elements, 54 and 56 and steam inlet means 50. Such electrical heating means are well known in the art. The outlet of the heating means is attached to the inlet 17 of the jet.

Control means 58, such as a switch, detects the presence or absence of yarn plug 20 at a predetermined point, such as near the outlet of crimping means 16 at point 59.

The temperature of the heating fluid used in crimping means 16 depends to a large extent upon the yarn being processed both for the temperature of the heating fluid used during string up and the temperature of the heating fluid used to crimp the yarn. For most yarns, the temperature of the heating fluid used in crimping means 16 to crimp the yarn should be above the melting point of the yarn in order to obtain good yarn crimp. During crimping, the yarn does not melt since its speed through the crimping means does not allow the yarn to reach the melt temperature. Since it is desirable to pass heating fluid to crimping means 16 during string up to minimize the time required to reach the crimping temperature in crimping means 16 in accordance with the invention, the heating fluid is heated to a first temperature during string up and to a second temperature when the processing line is running and yarn is passin through the crimping zone to produce the yarn plug. The second temperature which could be called the run or operating temperature is a higher temperature than the string up temperature. For example, when nylon 6, polycaprolactam, is crimped, the string up or first temperature normally ranges from about 290° F. (143° C.) to about 400° F. (204° C.) and the operating or second temperature normally ranges from about 400° F. (204° C.) to about 420° F. (215° C.). When nylon 66, poly(hexamethylene)adipamide, is crimped, the string up or first temperature normally ranges from about 290° F. (143° C.) to about 475° F. (246° C.) and the operating or second temperature normally ranges from about 490° F. (254° C.) to about 540° F. (282° C.). The two temperatures of the heating fluid used in crimping means 16 are obtained by using heating means 54. An example of a suitable heating means 54 is an electrical heater for superheating a heating fluid such as steam. The string up temperature is obtained by operating the first heating element 54 of heating means 52. Heating element 54 is generally operated on a continuous basis and operation of additional heating element 56 of heating means 52 raises the temperature of the heating fluid to the operating temperature. Operation of heating element 56 is controlled by control means 58 when control means 58 detects the presence of yarn plug 20 at a predetermined point 59. As shown in the drawing, control means 58 is attached to the top of crimping means 16 near the yarn plug outlet in order to detect the presence or absence of the plug at point 59; however, it is possible to position control means 58 at another location as long as the output of the control means provides an indication as to the presence or absence of the yarn plug 20 at a predetermined point.

It is not necessary that heating means 54 have two heating elements as long as the heating means is capable of heating the heating fluid to two different temperatures, one of which is suitable for stringing up the yarn and the other for crimping the yarn. For example, the heating means could be two separate heaters operated in series or a single heater having only one heating element capable of being operated at two voltages to achieve the two different heating fluid temperatures required to practice the invention. The temperature of the heating fluid used during string up should be low enough to prevent the yarn from melting in crimping means 16 but high enough to minimize the time required to raise the temperature of crimping means 16 to the crimping temperature.

Again referring to the drawing, the crimped yarn 4 is tensioned by tension pins 28 and passed through an entangler 30. The crimped and entangled yarn 4 is passed over guide 34 and on to a withdrawal roll 36. The crimped and entangled yarn 4 is exposed to relatively high tension by a constant tension winder 40 after passing over guide 42. While the yarn is exposed to the relatively high tension, the yarn is heated by a suitable yarn heater 38 with the heating fluid entering and exiting the chamber at 82 and 39, respectively.

Further, in accordance with another embodiment of the invention the heating fluid used in yarn heating means 38 is provided by a suitable heating means 74, such as an electrical heater similar to heating means 52, but heating means 74 needs only one heating element 76. The heating fluid is fed to heater 74 through line 78 connected to a heating fluid source (not shown) through control valve 80 which is connected to the inlet of heating means 74 via line 72. The heated fluid is then passed to yarn heater inlet 82. The electrical element 76 of heating means 74 and control valve 80 are operated by heating fluid control means 70 such as a microswitch which is positioned so as to determine if yarn is being wound, such as, for example, adjacent tension arm 68 of winder 40. Control means 70 could also be positioned between guide 42 and tension arm 68 to sense the movement of the yarn.

In the operation of straightening zone 37, a source of heating fluid such as steam passes through control valve 80 via line 78 and on to fluid heating means 74 which heats the heating fluid to the desired temperature when an electrical voltage is applied across heating element 76 of heating means 74. The heated fluid then passes to yarn heating means 38 via line 82.

The operation of heating means 74 and control valve 80 in accordance with this embodiment of the invention is controlled by control means 70 which is positioned under tension arm 68 of yarn winder 40. When winder 40 is winding yarn, tension arm 68 moves upward which is detected by control means 70 which in turn provides an output which opens control valve 80 and applies an electrical voltage across heating element 76 of heating means 74.

The temperature of zone 37 combined with the tension on the yarn should be high enough to straighten the yarn but not too high to cause the crimp to be permanently removed from the yarn. The proper temperature range depends upon the yarn being processed. For example, when nylon 6, polycaprolactam, or nylon 66, poly(hexamethylene)adipamide are processed, zone 37 is operated at a temperature ranging from about 250° F. (121° C.) to about 275° F. (135° C.). It should be kept in mind that all of these parameters, i.e., heat, moisture and tension, effect the straightening of the yarn and each parameter should be adjusted in relation to the others.

The tension of the yarn in the entangling zone 32 is normally relatively low as compared with the tension of the yarn in the heat treatment zone 37. This is because high tension in the entangling zone 32 would tend to defeat the entangling process. Also a low tension in the straightening zone 37 would impede the straightening process; thus the entangling and straightening zones are usually isolated by some means, as, for example, the withdrawal roll 36.

The length of yarn plug 20 in the crimping means 16 is inversely proportional to the temperature of the yarn in the crimping means. Increasing the temperature of the yarn in the crimper causes the yarn to shrink, increasing the denier of the yarn and thus decreasing the yarn plug length. Therefore, decreasing the temperature of the yarn increases the yarn plug length. Temperature controller 31 controls the temperature of the feed roll 10 which in turn controls the temperature of the yarn entering the crimping means and consequently the length of the yarn plug. Temperature controller 31 is set to maintain the temperature of the roll being controlled at a preset temperature or set point. This temperature controller is of a standard type which senses the resistance of a temperature-sensitive device, such as a thermistor.

In setting the set point of temperature controller 31, the controller should have a set point at which the temperature of the roll being controlled is maintained so that the yarn plug length is maintained just above the electric eye beam 27*a*, that is, where the plug just breaks the beam. When the electric eye beam 27*a* is broken by the yarn plug end 25, the by-pass circuit is activated, causing the temperature controller 31 to increase the temperature of the roll being controlled above the set point. This in turn increases the temperature of the yarn and thus lowers the yarn plug height or yarn plug end 25 until the electric eye 27 is exposed to light beam 27*a*, indicating the yarn plug end 25 is lower than the light beam. Therefore, temperature controller 31 tries to maintain the end of the yarn plug 25 just above the electric eye beam and the electric eye 27 tries to maintain the end of the yarn plug just below the electric eye beam. This competition approaches an equilibrium which results in excellent control of the yarn plug length and crimp level.

Temperature controller 31 is commonly known as a standstill temperature offset controller of the proportional type. However, other controllers can be used, such as those that sense voltage rather than resistance.

The tension of the yarn in the entangler should be set to facilitate good entangling. The tension of the yarn in zone 26 can be somewhat less than the tension of the yarn in zone 32, which is just prior to entangling.

Heat, moisture and tension are applied to the yarn prior to packaging in zone 37. These parameters can be varied to control the degree of straightening the yarn experiences. Moisture affects some yarn differently than others. For example, nylon is generally influenced by moisture more than polyester or polypropylene. That is, in processing nylon, it has been found that moisture is a more important parameter in the yarn straightening step than for either polyester or polypropylene. A convenient method of heating and moisturizing the nylon yarn is to use water as the fluid which is heated in heater 74 and thus saturated steam is used to heat the yarn in zone 37. However, other means and fluids for both heating and moisturizing the yarn can be used.

The tension of the yarn in zone 37 should be sufficient to straighten the yarn but not high enough to draw the yarn. This tension is generally higher than the tension of the yarn during entangling. For processing nylon yarns, excellent results were obtained using a tension in the range of 0.04 to 0.12 grams/denier in zone 37.

In addition, by practicing the present invention, the yarn can be completely processed in one continuous operation without allowing the yarn to cool at ambient temperature once the processing has begun. Most yarns have a tendency to degrade to some extent each time they are reheated. If the yarn can be processed in one continuous operation as in the practice of the present invention where the yarn is not completely cooled down and then reheated again, the yarn processed will be subjected to fewer conditions which promote degradation and thus be a higher quality yarn.

The process of this invention results in a packaged yarn in which the package itself has a high density, the yarn is straight and easy to use for tufting or other textile processes and the bulk returned by applying heat to the yarn. It is important for the yarn to be wound while still warm and under desired tension. This increases the yarn's stability with regard to its straightened condition once tension is relaxed.

While the above process is applicable generally to synthetic filament yarns capable of being crimped, entangled, straightened, and subsequently bulked by heating, it is particularly useful in processing the thermoplastic yarns including these of polyester and polyolefin and, more especially, polyamides such as polycaprolactam (nylon 6) and poly(hexamethylene)adipamide (nylon 66).

What I claim is:

1. Apparatus comprising:

yarn crimping means for heating a yarn with a heated fluid and producing a yarn plug;

fluid heating means, comprising first and second heating elements, for selectively heating a fluid to either a first temperature by operation of said first heating element or to a second temperature by simultaneous operation of said first and second heating elements, said second temperature being the temperature used for crimping the yarn and said first temperature being the temperature used for stringing up the apparatus, said second temperature being a higher temperature than said first temperature;

means connecting the fluid heating means to the yarn crimping means for passing of the heated fluid from the fluid heating means to the yarn crimping means;

control means positioned downstream of said crimping means for regulating the temperature of the heated fluid heated by the heating means to the first temperature or the second temperature in response to whether the yarn plug is detected at a predetermined point by the control means so that the heated fluid is heated to the first temperature if the yarn plug is not detected at said point and the heated fluid is heated to the second temperature if the yarn plug is detected at said point.

2. The apparatus of claim 1 wherein the heating means comprises first and second heating elements operated in series.

3. The apparatus of claim 1 wherein said first temperature is below the melting temperature of the yarn and said second temperature is above the melting temperature of the yarn.

4. The apparatus of claim 3 wherein the fluid heating means comprises an electrically operated steam superheater, wherein said first and second heating elements comprise first and second separate and independent heating elements, and wherein said first heating element is in continuous operation.

5. The apparatus of claim 4 wherein the yarn crimping means is a fluid jet, the heating fluid is superheated steam, and the control means is a microswitch which operates the second element of said heater when the yarn plug is detected by said microswitch at the outlet of the fluid jet.

6. Apparatus comprising:

yarn crimping means for heating a yarn with a heated fluid and producing a yarn plug;

fluid heating means for heating a fluid to a first and a second temperature, said second temperature being the temperature used for crimping the yarn and said first temperature being the temperature used for stringing up the yarn in the apparatus, said second temperature being a higher temperature than said first temperature;

means connecting the fluid heating means to the yarn crimping means for passing of the heated fluid from the fluid heating means to the yarn crimping means;

control means positioned downstream of said crimping means for regulating the temperature of the heated fluid heated by the heating means to the first temperature or the second temperature in response to whether the yarn plug is detected at a first predetermined point by the control means so that the heated fluid is heated to the first temperature if the yarn plug is not detected at said point and the heated fluid is heated to the second temperature if the yarn plug is detected at said point;

monitoring means for monitoring the length of the yarn plug with respect to a second predetermined point positioned downstream of said crimping means and said first predetermined point;

second control means for regulating the temperature of the yarn passed to said yarn crimping means wherein said second control means increases the temperature of the yarn passed to said yarn crimping means if said yarn plug is at or downstream of said second predetermined point and said control means decreases the temperature of the yarn passed to said yarn crimping means if said yarn plug is upstream of said second predetermined point.

7. The apparatus of claim 6 further comprising yarn heating means positioned for heating the crimped yarn produced in said yarn crimping means;

a second fluid heating means for heating a second fluid to a temperature;

means connecting the second fluid heating means to the crimped yarn heating means for passage of the second heated fluid from the second fluid heating means to the crimped yarn heating means;

constant tension winding means positioned to wind the yarn heated in said crimped yarn heating means; and fluid control means for controlling the passage of fluid to the second fluid heating means and heating the second fluid to said temperature in response to the winding of yarn so that the second heating fluid is passed to the crimped yarn heating means only if yarn is being wound.

8. The apparatus of claim 6 wherein said first temperature is below the melting temperature of the yarn and said second temperature is above the melting temperature of the yarn.

9. The apparatus of claim 8 wherein the fluid heating means is an electrically operated steam superheater having first and second separate and independent heating elements wherein the operation of the first element heats the steam to said first temperature and said first element is in continuous operation and the simultaneous operation of said first and second elements heats the steam to said second temperature.

10. The apparatus of claim 8 wherein the heating means comprises two separate heaters operated in series wherein the operation of one of the heaters heats the fluid to said first temperature and the operation of both the heaters heats the fluid to said second temperature.

11. Apparatus comprising:

yarn heating means for heating a yarn with a heated fluid;

fluid heating means for heating a fluid to a temperature;

valve means for shutting off the flow of fluid to said fluid heating means;

means connecting the fluid heating means to the yarn heating means for passage of the heated fluid from the fluid heating means to the yarn heating means;

constant tension winding means positioned to wind the yarn heated in said yarn heating means; and fluid control means for maintaining said valve means open to permit the passage of fluid to the fluid heating means and heating the fluid to said temperature in response to the winding of yarn so that heating fluid is passed to the yarn heating means only if yarn is being wound, said fluid control means comprising means for actuating said valve means to shut off the flow of fluid to said fluid heating means when yarn is not being wound.

12. The apparatus of claim 11 wherein the yarn heating means comprises a longitudinal member having a cylindrical passage therethrough having an axis parallel with the longitudinal axis of said member and having at least one heating fluid inlet in communication with said passage;

wherein the fluid heating means is an electrical heater suitable for producing saturated steam;

wherein the means connecting the fluid heating means to the yarn heating means is an insulated pipe;

wherein said valve means comprises an electrically operated valve for shutting off the flow of fluid to said fluid heating means; and wherein the fluid control means comprises a microswitch positioned on the winder to sense the winding of yarn and connected to said valve to actuate same.

13. Apparatus comprising:

yarn crimping means for heating a yarn with a heated first fluid and producing a yarn plug;

first fluid heating means for selectively heating a first fluid to either a first or a second temperature, said second temperature being the temperature used for crimping the yarn and said first temperature being the temperature used for stringing up the apparatus, said second temperature being a higher temperature than said first temperature;

means connecting the first fluid heating means to the yarn crimping means for passing of the heated first fluid from the first fluid heating means to the yarn crimping means;

control means positioned downstream of said crimping means for regulating the temperature of the heated first fluid heated by the first fluid heating means to the first temperature or the second temperature in response to whether the yarn plug is detected at a predetermined point by the control means so that the heated first fluid is heated to the first temperature if the yarn plug is not detected at said point and the heated first fluid is heated to the second temperature if the yarn plug is detected at said point;

yarn heating means positioned for heating the crimped yarn produced in said yarn crimping means;

a second fluid heating means for heating a second fluid to a temperature;

means connecting the second fluid heating means to the crimped yarn heating means for passage of the second heated fluid from the second fluid heating means to the crimped yarn heating means;

constant tension winding means positioned to wind the yarn heated in said crimped yarn heating means; and fluid control means for controlling the passage of fluid to the second fluid heating means and heating the second fluid to said temperature in response to the winding of yarn so that the second heating fluid is passed to the crimped yarn heating means only if yarn is being wound.

* * * * *